US006433485B2

(12) United States Patent
Tai et al.

(10) Patent No.: US 6,433,485 B2
(45) Date of Patent: Aug. 13, 2002

(54) APPARATUS AND METHOD OF TESTING AN ORGANIC LIGHT EMITTING DIODE ARRAY

(75) Inventors: Ya-Hsiang Tai, Taipei; Yeong-E Chen, Hsinchu Hsien, both of (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/826,013

(22) Filed: Apr. 5, 2001

(30) Foreign Application Priority Data

Jun. 5, 2000 (TW) ..... 89111096

(51) Int. Cl.[7] ..... G09G 3/10
(52) U.S. Cl. ..... 315/169.2
(58) Field of Search ..... 315/169.1, 169.2, 315/170, 169.3, 169.4; 438/14, 19, 99; 345/56, 76; 73/157

(56) References Cited

U.S. PATENT DOCUMENTS 5,952,789 A * 9/1999 Stewart et al. ..... 315/169.4
6,191,534 B1 * 2/2001 Schuler et al. ..... 315/169.3
6,265,832 B1 * 7/2001 Maisel et al. ..... 315/164
6,307,322 B1 * 10/2001 Dawson et al. ..... 315/169.1

* cited by examiner

*Primary Examiner*—Don Wong
*Assistant Examiner*—A D Minh
(74) *Attorney, Agent, or Firm*—Birch, Stewart, Kolasch & Birch, LLP

(57) ABSTRACT

An apparatus and method of testing an organic light emitting diode array are disclosed. A current meter and voltage source are serially connected between a common line and power supply line shared by any pixel unit. Specific logic values are sequentially written to the pixel units via signal lines and the current readings corresponding the pixel units are taken by the current meter. Whether the pixel units are defective can be determined according to the current readings. The defective type of a pixel units can be determined according to the current reading corresponding to the defective pixel unit and the current readings corresponding the other perfect pixel units.

18 Claims, 7 Drawing Sheets

100 200

| | | | |
|---|---|---|---|
| 0nA | 0nA | 0nA | 0nA |
| 0nA | 0nA | 0nA | 0nA |
| 0nA | 0nA | 0nA | 0nA |

100 200

| | | | |
|---|---|---|---|
| 1nA | 1nA | 1nA | 1nA |
| 1nA | 0nA | ?nA | 1nA |
| 1nA | 1nA | 1nA | 1nA |

300 400

| | | | |
|---|---|---|---|
| 1nA | 1nA | 1nA | 1nA |
| 1nA | 1nA | 1nA | 1nA |
| 1nA | 1nA | 1nA | 1nA |

300 400

| | | | |
|---|---|---|---|
| 2nA | 2nA | 2nA | 2nA |
| 2nA | ?nA | 1nA | 2nA |
| 2nA | 2nA | 2nA | 2nA |

500 600

| | | | |
|---|---|---|---|
| 1nA | 1nA | 1nA | 1nA |
| 1nA | 1nA | 1nA | 1nA |
| 1nA | 1nA | 1nA | 1nA |

500 600

| | | | |
|---|---|---|---|
| 2nA | 2nA | 2nA | 2nA |
| 2nA | 1nA | 1nA | 2nA |
| 2nA | 2nA | 2nA | 2nA |

APPARATUS AND METHOD OF TESTING AN ORGANIC LIGHT EMITTING DIODE ARRAY

BACKGROUND OF THE INVENTION

1. Field of the Invention

The present invention relates in general to a testing apparatus and method of an organic light emitting diode (hereinafter referred to as OLED) array. More specifically, it relates to the testing apparatus and method of checking for defective pixel units of an active matrix OLED panel.

2. Description of the Related Art

Newly developed flat-plane displays, succeeding cathode ray tube (CRT) displays and liquid crystal displays (LCDs), are OLED displays. OLED displays have the advantages of self-emitting light, high luminance, wide viewing angle, and a simple fabricating process, etc., therefore hold appeal for researchers lately. An OLED emits light by using an organic light-emitting layer disposed between the anode and cathode thereof. The organic light-emitting layer is composed of dyes or high polymers.

FIG. 1 shows the schematic structure of a general OLED in a cross-sectional view. As depicted in FIG. 1, numeral 1 shows a substrate which generally is made of glass material and serves as an emitting plane. Numeral 3 shows an anode layer which is transparent and made of metal oxide such as ITO (indium tin oxide) with good conductivity and is also pervious to light. Numeral 5 shows an organic layer supposed to have highly efficient fluorescence. Numeral 7 shows a cathode layer generally made of a metallic alloy. Physically, respectively connecting the anode layer 3 and cathode layer 7 to a positive electrode and negative electrode is equivalent to injecting holes and electrons into the organic layer 5. After the holes and electrons overcome the respective energy gaps, excitons are generated in the organic layer 5. The excitons decay from an excited state to a fundamental state, thereby radiating light for releasing energy. The anode layer 3 and substrate 1 are transparent and the light radiates along the arrow direction as depicted in FIG. 1.

In general, OLED displays include two driving types: passive matrix and active matrix. In a passive matrix OLED display, an organic layer is deposited between cathode electrode lines and anode electrode lines, wherein the cathode electrode lines are perpendicular to the anode electrode lines, thereby forming an array of OLEDS. Furthermore, switches corresponding to the OLED circuit are used to control the light emission of OLEDS. FIG. 2 shows the circuit diagram of a conventional passive matrix OLED display. In FIG. 2, OLED panel 9 comprises cathode electrode lines 10 perpendicular to anode electrode lines 12. The diode at the cross section of any cathode electrode line 10 and any anode line 12 represents a corresponding pixel unit 20. Anode electrode lines 12 couples current sources 14 via switches 18 and cathode electrode lines 10 are coupled to a ground via switches 16. In practical operation, the scan lines corresponding to the cathode electrode lines 10 are sequentially turned on, i.e. the corresponding switches 16 are conducted, to be grounded. Further, each of the pixel units 20 can be selectively lit by controlling the switches 18. To the passive matrix OLED, its simple structure is the main advantage favorable to fabricating cost and benefit. However, the passive matrix OLED operates under short-pulse mode, therefore requiring higher operating voltage. Also, the passive matrix OLED has a low efficiency of light emission.

In an active matrix OLED display, each of the OLEDs is coupled with an independently connected driving circuit.

FIG. 3 shows the circuit diagram of a conventional active matrix OLED display. In FIG. 3, numeral 50 means a switching TFT (thin-film transistor), numeral 52 means a storage capacitor, numeral 54 means a driving TFT, and numeral 56 means an OLED. In addition, numeral 30 means a signal line, numeral 40 means a scan line, numeral 32 means a power supply line, numeral 42 means a capacitor line, and numeral 44 means a common line.

The gate and source of the switching TFT 50 respectively connect to the scan line 40 and the signal line 30. The drain of the switching TFT 50 connects to the storage capacitor 52. A scan signal is provided via the scan line 40 to control the state of the switching TFT 50. When the switching TFT 50 is in conducted state (or turned on), logic signals at the signal line 30 are transmitted to node A. In addition, the other terminal of the storage capacitor 52 connects to the capacitor line 42. Generally every capacitor line 42 of all pixel units in an OLED panel is commonly connected. The logic signal at node A is coupled to the gate of the driving TFT 54, and the source and drain of the driving TFT 54 respectively connect to the power supply line 32 and the anode of the OLED 56. The cathode of the OLED 56 connects to common line 44. When the logic signal at node A turns on the driving TFT 54, the path from the power supply line 32, driving TFT 54, OLED 56 to common line 44 forms a loop and the OLED 56 emits light. When the driving TFT 54 is not in a conducted state (turned off), OLED will not emit light. In addition, generally every power supply line 32 and common line 44 of all pixel units in the OLED panel are respectively connected together; wherein the power supply line 32 couples to a positive voltage, and the common line 44 is grounded.

As described above, the driving TFT structure of the active matrix OLED is partially similar with that of a LCD panel, for example the switching TFT 50 and the storage capacitor 52. However, the pixel unit structures of the OLED and LCD are different. Therefore, the conventional apparatus for testing the LCD panel is not appropriate for the OLED panel.

FIG. 4 shows a conventional testing scheme for an active matrix LCD panel. In FIG. 4, numeral 62 and 60 mean a control transistor and storage capacitor corresponding to a pixel unit and the gate of the control transistor connects to a scan line 72. Numeral 74 means a testing point, the input position of image signals. Testing apparatus comprises a switch 65, a voltage source 69, and a judging device 67. The switch 65 controls the selection of connecting the judging device 67 or voltage source 69 to the testing point 74. The way of testing is described as follows. First, the switch 65 is switched to couple the voltage source 69 to the storage capacitor 60 so as to store charge in the storage capacitor 60 (i.e. node A'). Next, hold the charge stored in the storage capacitor 60 for a period of time, and then switch the switch 65 to the judging device 67. The judging device 67 reads out (detects) the charge stored in the storage capacitor and determines whether the pixel unit is perfect or defective.

Accordingly, it is not able to completely test a general OLED pixel unit by virtue of the testing scheme for a conventional active matrix LCD panel as shown in FIG. 4. The reason is that the testing scheme cannot be applied to test the driving TFT 54 and OLED 56 depicted in FIG. 3.

SUMMARY OF THE INVENTION

Therefore, an object of the present invention is to provide an apparatus and method of testing an OLED array (or panel), capable of completely finding out whether the pixel units in the OLED array are perfect or defective.

The present invention achieves the above-indicated objects by providing a method of testing an OLED array, which has a plurality of pixel units and each of the pixel units comprises a commonly shared power supply line and a commonly shared common line. First, a current meter and a voltage source are provided and connected in serial between the common line and power supply line. Then, a first logic value (for example, logic "1") is sequentially written to the pixel units and first current readings corresponding to the written pixel units are taken by virtue of the current meter. Finally, whether or not the pixel units are defective is determined according to the first current readings corresponding to the written pixel units; further, when a pixel unit is determined to be defective, the defective type of the defective pixel unit is determined according to the first current reading corresponding to the defective pixel unit and the first current readings corresponding the other perfect pixel units. In addition, a second logic value (for example, logic "0") can be sequentially written to the pixel units and second current readings corresponding to the written pixel units that are taken by virtue of the current meter. The defective type of the defective pixel unit can be determined according to the first and second current readings corresponding to the defective pixel unit and the first and second current readings corresponding the other perfect pixel units when the pixel unit is determined to be defective. In addition, the testing method includes the testing of the storage capacitor so as to detect short-circuited defects. The steps of testing the storage capacitor are (1) storing charges in the pixel units, (2) reading the charges stored in the pixel units after a specific time period; and (3) determining whether the pixel units are defective according to the readings of the charges.

The present invention also provides an apparatus of testing an OLED array that comprises a voltage source for providing a bias voltage to the power supply line and common line; a writing circuit for sequentially writing a first logic value to the pixel units; a current meter serially connected with the voltage source for reading the currents passing between the power supply line and common line and generating first current readings corresponding to the pixel units; and a determining portion coupled to the current meter for determining whether the pixel units are defective according to the first current readings corresponding to the pixel units. The determining portion also determines the defective type of the defective pixel unit according to the first current reading corresponding to the defective pixel unit and the first current readings corresponding the other perfect pixel units. Moreover, the writing circuit also can sequentially write a second logic value to the pixel units and the current meter takes second current readings corresponding to the written pixel units. The determining portion determines whether the pixel units are defective according to the first and second current readings corresponding to the pixel units. Also, the determining portion determines the defective type of a defective pixel unit according to the first and second current reading corresponding to the defective pixel unit and the first and second current readings corresponding to the other perfect pixel units when the pixel unit is defective.

BRIEF DESCRIPTION OF THE DRAWINGS

The following detailed description, given by way of example and not intended to limit the invention solely to the embodiments described herein, will best be understood in conjunction with the accompanying drawings, in which.

DETAILED DESCRIPTION OF THE PREFERRED EMBODIMENT

Figure 1:
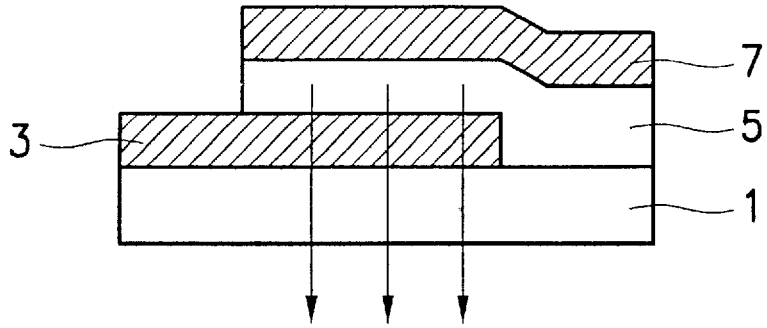
FIG. 1 shows the schematic structure of a general OLED in a cross-sectional view.
Figure 2:
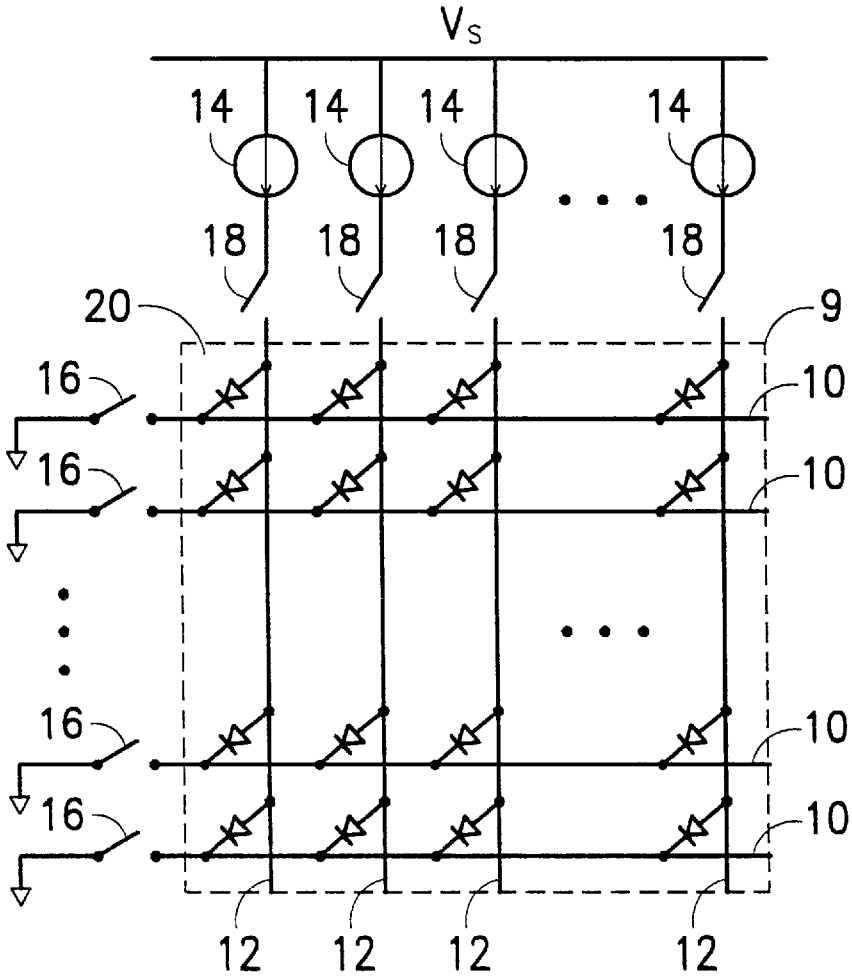
FIG. 2 shows the circuit diagram of a conventional passive matrix OLED display.
Figure 3:
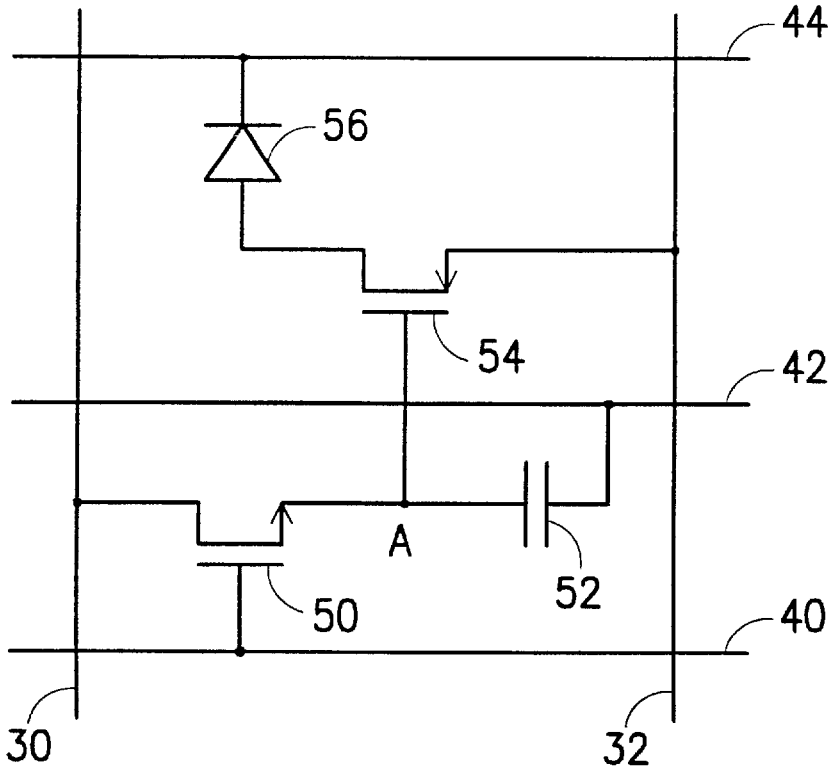
FIG. 3 shows the circuit diagram of a conventional active matrix OLED display.
Figure 4:
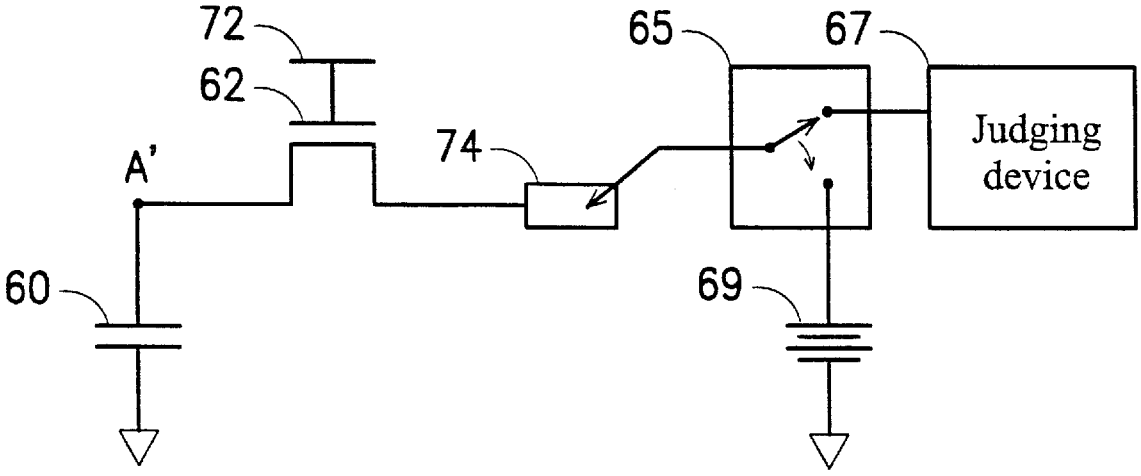
FIG. 4 shows a conventional testing scheme for an active matrix LCD panel.
Figure 5:
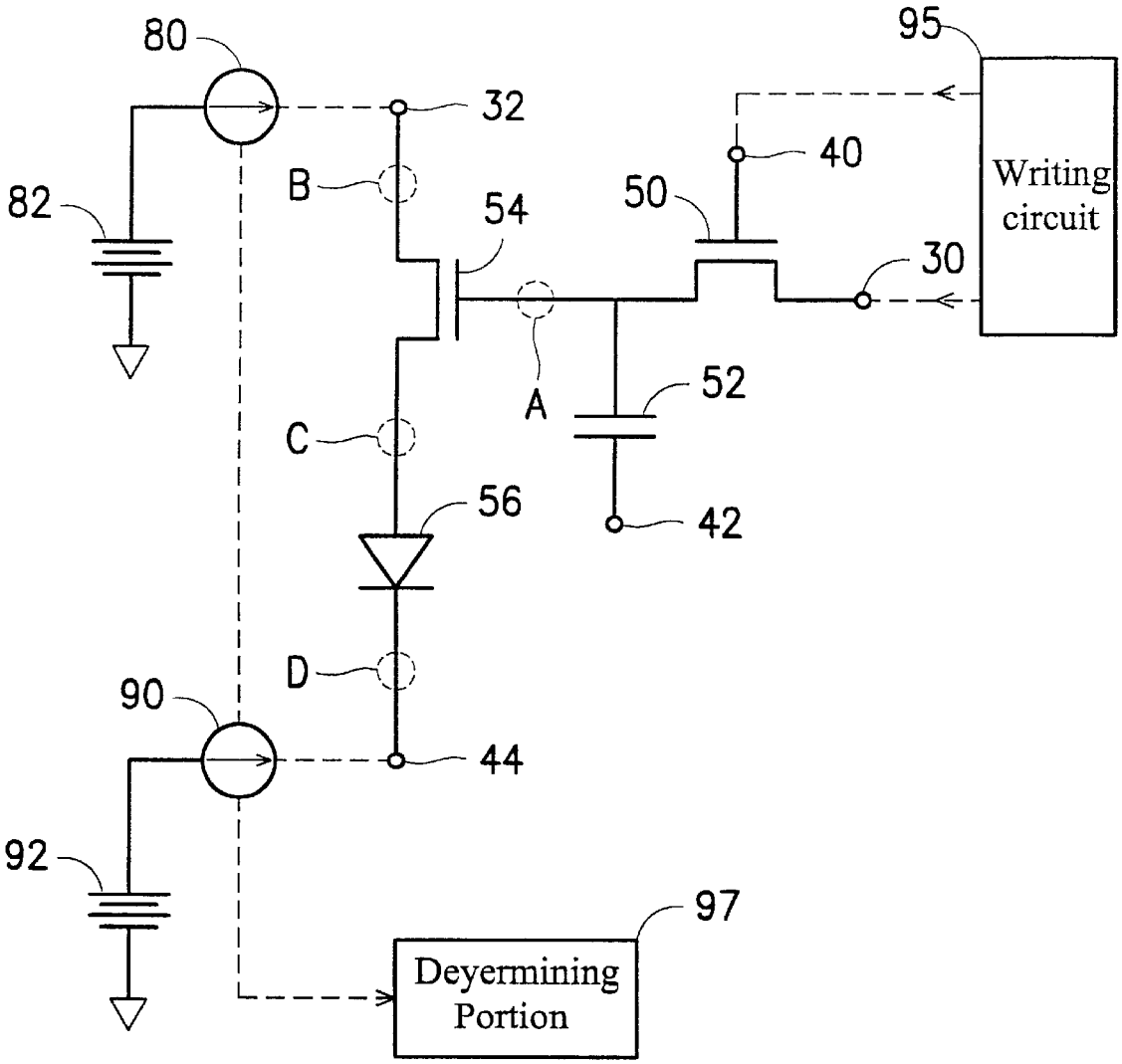
FIG. 5 shows an testing scheme for an active matrix OLED array (or panel).

FIG. 5 shows an testing scheme for an active matrix OLED array (or panel). In FIG. 5, portion of the elements in an OLED pixel unit is represented by the same numerals or notations depicted in FIG. 3. Node A means the intersection point of the storage capacitor 52 and the gate of the switching TFT 54. Node B means the source terminal of the switching TFT 54. Node C means the intersection point of the drain of the switching TFT 54 and the anode of the OLED 56. Node D means the cathode of the OLED 56. In fact, nodes A~D respectively represent the segments of corresponding positions in the OLED pixel unit. In FIG. 5, a testing apparatus comprises a current meter 80 connected to the power supply line 32, a voltage source 82, a current meter 90 connected to the common line 44, a voltage source 92, writing circuit 95 for writing logic value "1" or "0" to a pixel unit, and a determining portion 97 for finding out defects and identifying defect types according to the values read from the current meters 80 and 90. What is depicted in FIG. 5 is the general structure of the testing apparatus, but in practical application only one current meter and one voltage source are required. The writing circuit 95 can write logic value "1" or "1" to node A, voltage sources 82 and 92 bias the circuit comprising the driving TFT 54 and OLED 56, and the current meters 80 and 90 measure the currents passing through the driving TFT 54 and OLED 56. Finally, the determining portion 97 decides whether defects exist or not, and the possible types of defects. Although FIG. 5 merely illustrates only one pixel unit, the current meter can equivalently detect the current passing through all pixel units because every pixel unit connects to the power supply line 32 and common line 44. In this embodiment, when testing a pixel unit, logic values "1" and "0" are sequentially written to node A of the pixel unit, and then the current readings are taken by virtue of the current meters. Every current reading includes the current passing through the pixel unit undergoing testing and that through the other pixel unit. Variations of current readings resulting from a variety of defect types are described hereinafter.

First, the pixel unit under testing is supposed to be perfect and not effected by the other pixel units. if logic value "0" is written to node A, the reading of the current meter is zero because the driving TFT 54 is not conducted (i.e. turned on). If logic value "1" is written to node A, the reading of the current meter is not zero, wherein the current reading or value (hereinafter referred to as Id) depends on the equivalent resistance of the OLED 56 when the OLED 56 is conducted (turned on). However, since the power supply line 32 and common line 44 are commonly used by all pixel units, practical variations of the current readings are more complicated. In other words, when specific defects exist in the other pixel units, the current readings may be changed.

When the pixel unit under testing is defective, the reading of the current meter will not be the same as the described above. Temporarily, the other pixel units are not taken into consideration. Considering the first defect type, when an open-circuited defect appeals at node B, C or D, the reading of the current meter is zero and the OLED 56 will not emit light, whether the logic value at node A is "1" or "0". Considering the second defect type, when a short-circuited defect appeals between nodes B and C, the driving TFT fails to operate, the reading of the current meter is always Id and the OLED 56 will emit light, whether the logic value at node A is "1" or "0". Considering the third defect type, when a short-circuited defect appeals between nodes C and D, the driving TFT still operates its controls; however the equivalent resistance between nodes C and D is different from that of the OLED 56 when conducted (turned on), and therefore the reading of the current meter is greater than Id and the OLED will not emit light when the logic value at node A is "1".

In addition, some defects appearing in the other pixel units may affect the reading of the current meter undergoing testing. For example, when a short-circuited defect appears between the nodes B and C of any other pixel unit, a steady current is generated, resulting in increasing the present reading of the current meter by an increment of Id.

Several examples are given as follows to explain how to determine which pixel unit is defective and its defect type by virtue of the reading of the current meter.

Figures 6A, 6B, 6C:
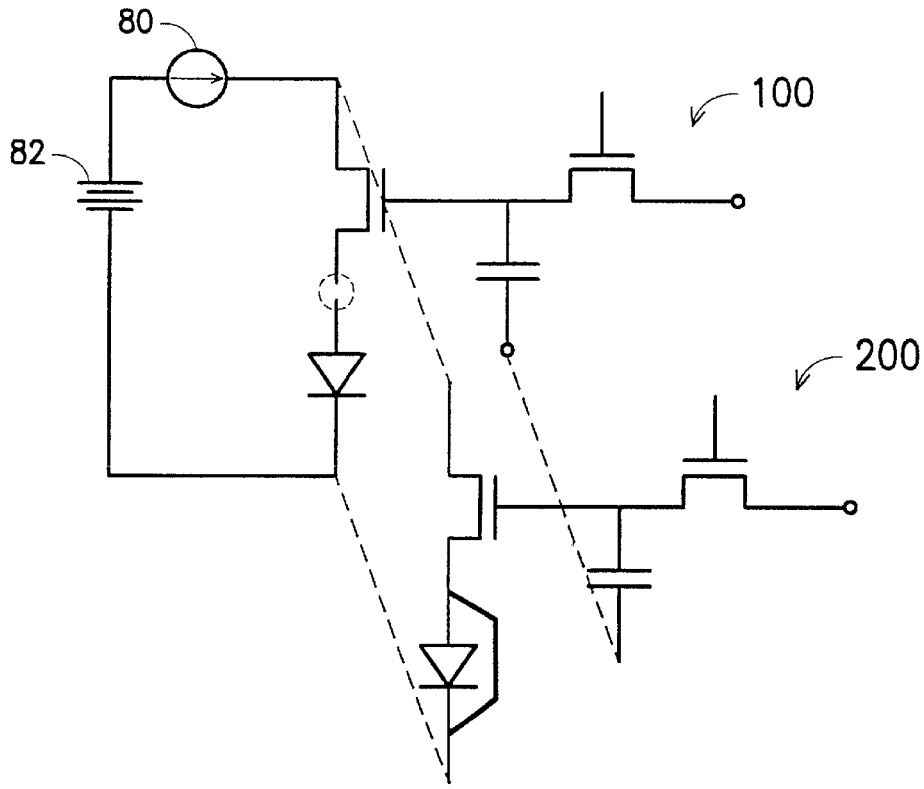
FIG. 6*a* shows a testing scheme of detecting defect types of OLED pixel units according to the first example of the embodiment in the present invention.
FIG. 6*b* shows the current readings taken from the current meter when logic "0" is written to every pixel unit.
FIG. 6*c* shows the current readings taken from the current meter when logic "1" is written to every pixel unit.

FIG. 6*a* shows a testing scheme of detecting defect types of OLED pixel units according to the first example of this embodiment in the present invention. An OLED array assumed to have 12 pixel units is used to explain the following examples. In FIG. 6*a*, two pixel units 100 and 200 have respective defect types. The testing process begins from writing logic value "0" to every pixel unit, and then respectively taking the readings of the current meter 80, wherein the readings are shown in FIG. 6*b*. Next, write logic value "1" to every pixel unit, and then respectively taking the readings of the current meter 80, wherein the readings are shown in FIG. 6*c* and Id is assumed to be 1 nA . An open-circuited defect appeals at node C of the pixel unit 100 as shown in FIG. 6*a*, and thus as described above, the reading of the current meter 80 is zero whether the logic value at node A of the pixel unit 100 is "1" or "0". In addition, a short-circuited defect appeals between nodes C and D of the pixel unit 200 as shown in FIG. 6*a*, i.e. the anode and cathode of the OLED (in pixel unit 200) is short-circuited, and thus as above described the reading of the current meter 80 is greater than 1 nA (in FIG. 6*c*, shown as "?"), whether the logic value at node A of the pixel unit 200 is "1" or "0". These two types of defects in pixel units 100 and 200 will not affect the testing result on the other pixel units, therefore the readings of the current meter in the other pixel units are the same as normal situations.

Figures 7A, 7B, 7C:
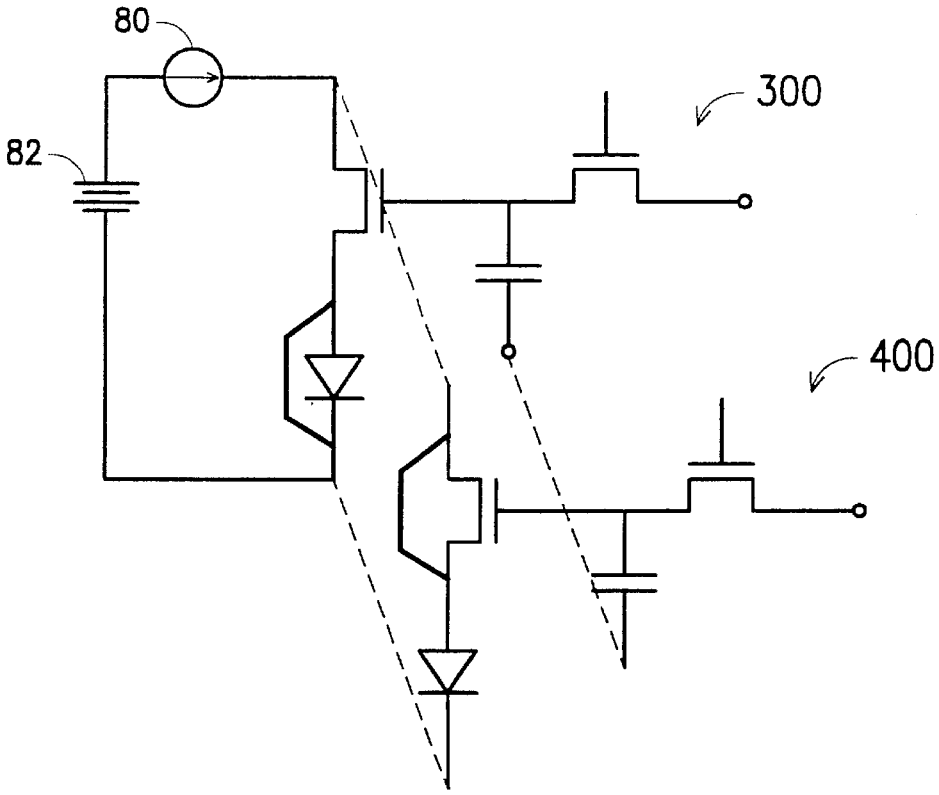
FIG. 7*a* shows a testing scheme of detecting defect types of OLED pixel units according to the second example of the embodiment in the present invention.
FIG. 7*b* shows the current readings taken from the current meter when logic "1" is written to every pixel unit.
FIG. 7*c* shows the current readings taken from the current meter when logic "1" is written to every pixel unit.

FIG. 7*a* shows a testing scheme for detecting defect types of OLED pixel units according to the second example of this embodiment in the present invention. In FIG. 7*a*, two pixel units 300 and 400 have respective defect types. FIG. 7*b* shows the table of current readings of all pixel units taken from the current meter 80, when a logic value "0" is written to every pixel unit. FIG. 7*c* shows the table of current readings of all pixel units taken from the current meter 80, when a logic value "1" is written to every pixel unit. A short-circuited defect appeals between nodes B and C of the pixel unit 400 as shown in FIG. 7*a*, disabling the driving TFT, and thus the reading of the current meter 80 is always 1 nA whether the logic value written to the pixel unit 400 is "1" or "0". It is noted that the defect type of the pixel unit 400 will influence the current readings and increase the readings by 1 nA when testing the other pixel units. For example, in FIG. 7*b* the current readings corresponding to the other pixel units are increased from 0nA to 1 nA , and in FIG. 7*c* the current readings corresponding to the other pixel units are increased from 1 nA to 2nA. In addition, a short-circuited defect appeals between nodes C and D of the pixel unit 300, and thus as described above the reading of the current meter 80 is greater than 1 nA (in FIG. 7*c*, shown as "?").

Figures 8A, 8B, 8C:
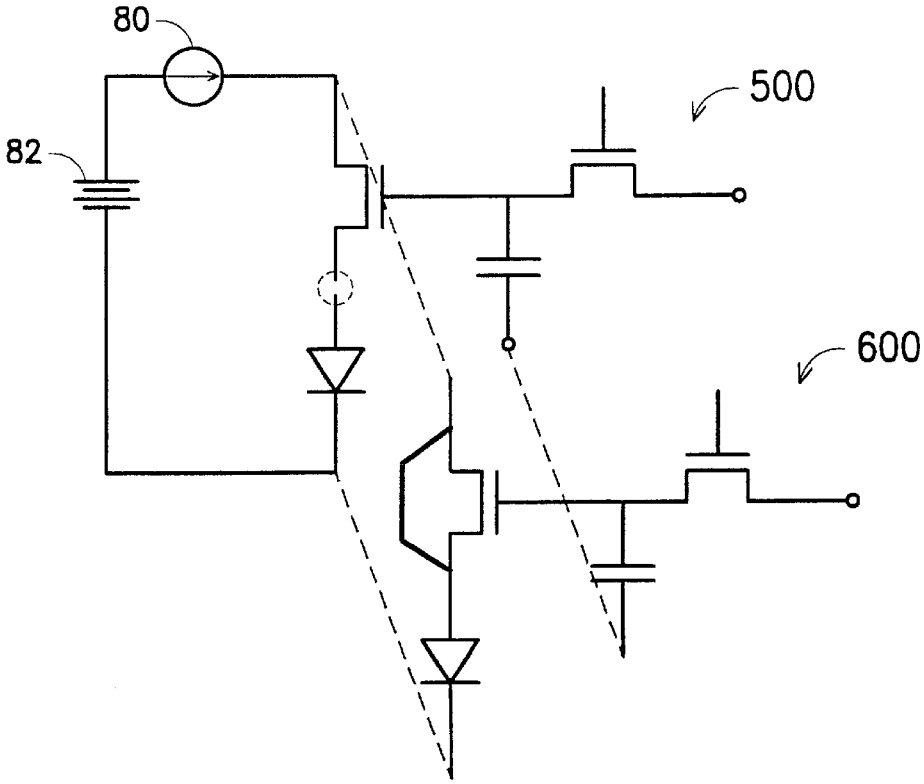
FIG. 8*a* shows a testing scheme of detecting defect types of OLED pixel units according to the third example of the embodiment in the present invention.
FIG. 8*b* shows the current readings taken from the current meter when logic "0" is written to every pixel unit.
FIG. 8*c* shows the current readings taken from the current meter when logic "1" is written to every pixel unit.

FIG. 8*a* shows a testing scheme of detecting defect types of OLED pixel units according to the third example of this embodiment in the present invention. In FIG. 8*a*, two pixel units 500 and 600 have respective defect types. FIG. 8*b* shows the table of current readings of all pixel units taken from the current meter 80, when a logic value "0" is written to every pixel unit. FIG. 8*c* shows the table of current readings of all pixel units taken from the current meter 80, when a logic value "1" is written to every pixel unit. Similar with the pixel unit 400, a short-circuited defect appeals between nodes B and C of the pixel unit 600 as shown in FIG. 8*a*, disabling the driving TFT, and thus the reading of the current meter 80 is always 1 nA no matter what the logic value written to the pixel unit 600 is "1" or "0". It is noted that the defect type of the pixel unit 600 will influence the current readings and increase the readings by 1 nA when testing the other pixel units. For example, in figure B*b* the current readings corresponding to the other pixel units are increased from 0 nA to 1 nA , and in FIG. 8*c* the current readings corresponding to the other pixel units are increased from 1 nA to 2 nA. In addition, an open-circuited defect appeals at node C of the pixel unit 500, and thus as described above, no current exists in the pixel unit 500 whether the logic value written to the pixel unit 500 is "1" or "0". However, the actual current reading (taken from the current meter 80) corresponding to the pixel unit 500 will be 1 nA owing to the influence of the pixel unit 600.

The following conclusions can be obtained according to the testing results of the first to third embodiments, referring to FIGS. 6*c*, 7*c* and 8*c*. First, which pixel unit is defective can be determined by virtue of judging the current readings measured when a logic value "1" is written. Second, if the current readings corresponding to all pixel units are increased by a specific value, it means that the source and drain of a driving TFT of some defective pixel unit are shorted together. No matter what a logic value of "1" or "0" is written to the defective pixel unit, the current readings corresponding to the other pixel units (without a short-circuited defect) are the same and non-zero. Third, if the current reading correspond to a specific pixel unit is zero whether a logic value "1" or "0" is written to the specific pixel unit, then an open-circuited defect appeals in the specific pixel unit. Fourth, if the current reading corresponding to a specific pixel unit is not an integral multiple of the current value Id when a logic value "1" is written to the specific pixel unit, then the anode and cathode of the OLED in the specific pixel unit are shorted together.

Figure 9:
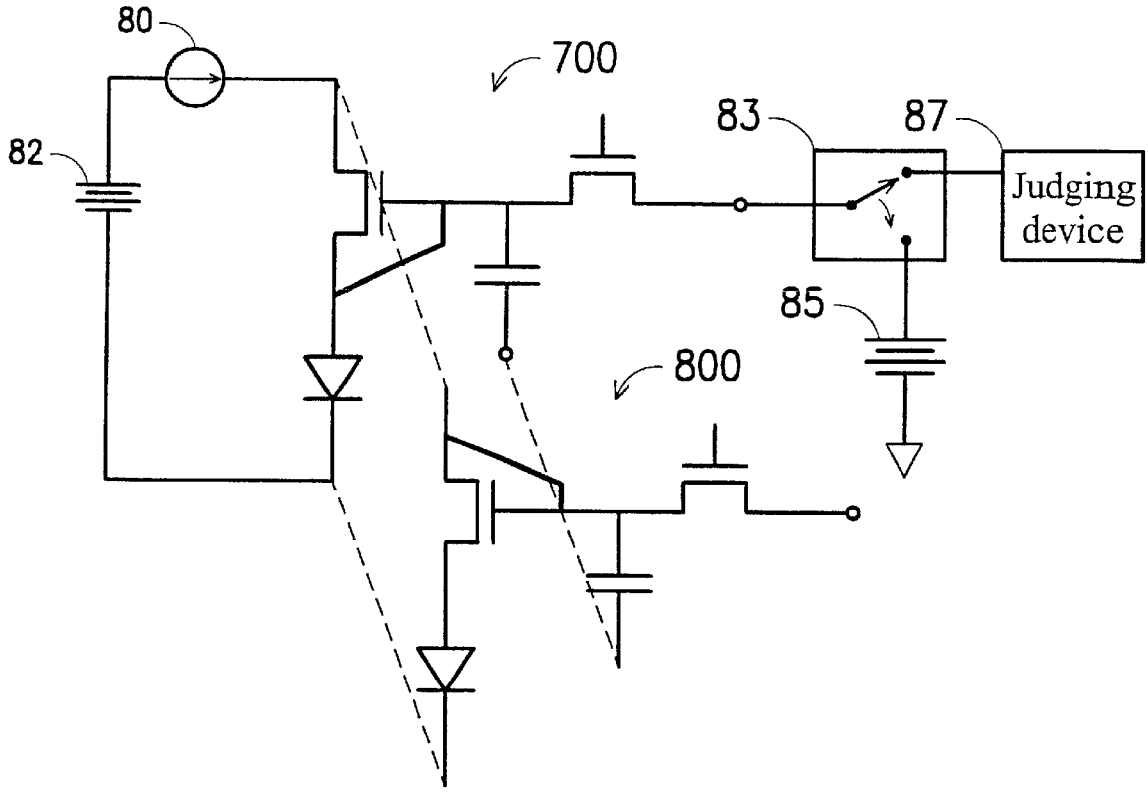
FIG. 9 shows a testing scheme of detecting defect types of OLED pixel units according to the fourth example of the embodiment in the present invention.

FIG. 9 shows a diagram of a defect type of OLED pixel units according to the fourth embodiment of the present invention. In FIG. 9, two pixel units 700 and 800 have respective defect types. The defect of the pixel unit 700 is that the gate and drain of the driving TFT are short-circuited, i.e. nodes A and C in FIG. 5 are short-circuited. The defect of the pixel unit 800 is that the gate and source of the driving TFT are short-circuited, i.e. nodes A and B in FIG. 5 are short-circuited. The defects appearing at the pixel units 700 and 800 are equivalent to a discharge path to the storage circuit. In other words, charge leakage will occur via the discharge path when there are charges stored in the storage capacitor. The conventional method of testing storage capacitors can be adopted to detect the above type of leakage defect. In FIG. 9, the switch 83 controls the connecting state for connecting the judging device 87 or voltage source 83 to the pixel unit to be tested. First, the switch 83 is switched to the voltage 85 to charge the storage capacitor. After holding the charge of the storage capacitor for a period of time, the switch 83 is switched to the judging device 87. Read out the charge of the storage capacitor and let the judging device 87 determine whether or not the pixel unit is defective. If such a type of defect of the pixel units 700 and 800 exist, then the judging device 87 can detect the reduction of the charge of the storage capacitor.

While the invention has been described by way of example and in terms of the preferred embodiment, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A method of testing an organic light emitting diode array, which has a plurality of pixel units and each of the pixel units comprises a commonly shared power supply line and a commonly shared common line, the method comprising the steps of:

providing a current meter and a voltage source connected in series between the common line and power supply line;

sequentially writing a first logic value to the pixel units and taking first current readings corresponding to the written pixel units by virtue of the current meter;

determining whether the pixel units are defective according to the first current readings corresponding to the written pixel units.

2. The method as claimed in claim 1, wherein the defective type of a defective pixel unit is determined according to the first current reading corresponding to the defective pixel unit and the first current readings corresponding the other perfect pixel units when the pixel unit is determined to be defective in the defect-determining step.

3. The method as claimed in claim 1, wherein the first logic value is logic "1".

4. The method as claimed in claim 1, further comprising the step of sequentially writing a second logic value to the pixel units and taking second current readings corresponding to the written pixel units by virtue of the current meter.

5. The method as claimed in claim 4, wherein the defective type of a defective pixel unit is determined according to the first and second current readings corresponding to the defective pixel unit and the first and second current readings corresponding the other perfect pixel units when the pixel unit is determined to be defective in the defect-determining step.

6. The method as claimed in claim 4, wherein the second logic value is logic "0".

7. The method as claimed in claim 4, further comprising the steps of:

storing charges in the pixel units;

reading the charges stored in the pixel units after a specific time period; and determining whether the pixel units are defective according to the readings of the charges.

8. The method as claimed in claim 1, further comprising the steps of:

storing charges in the pixel units;

reading the charges stored in the pixel units after a specific time period; and determining whether the pixel units are defective according to the readings of the charges.

9. An apparatus of testing an organic light emitting diode array, which has a plurality of pixel units and each of the pixel units comprises a commonly shared power supply line and a commonly shared common line, the apparatus comprising:

a voltage source for providing a bias voltage to the power supply line and common line;

a writing circuit for sequentially writing a first logic value to the pixel units; and a current meter serially connected with the voltage source for reading the currents passing between the power supply line and common, line and generating first current readings corresponding to the pixel units;

wherein whether the pixel units are defective are determined according to the first current readings corresponding to the pixel units.

10. The apparatus as claimed in claim 9, further comprising a determining portion coupling to the current meter for determining whether the pixel units are defective according to the first current readings corresponding to the pixel units.

11. The apparatus as claimed in claim 10, wherein the determining portion determines the defective type of a defective pixel unit according to the first current reading corresponding to the defective pixel unit and the first current readings corresponding the other perfect pixel units when the pixel unit is defective.

12. The apparatus as claimed in claim 11, wherein the first logic value is logic "1".

13. The apparatus as claimed in claim 10, wherein the first logic value is logic "1".

14. The apparatus as claimed in claim 9, wherein the first logic value is logic "1".

15. The apparatus as claimed in claim 9, wherein the writing circuit sequentially writes a second logic value to the pixel units and the current meter takes second current readings corresponding to the written pixel units.

16. The apparatus as claimed in claim 15, further comprising a determining portion coupled to the current meter for determining whether the pixel units are defective according to the first and second current readings corresponding to the pixel units; the determining portion determines the defective type of a defective pixel unit according to the first and second current reading corresponding to the defective pixel unit and the first and second current readings corresponding the other perfect pixel units when the pixel unit is defective.

17. The apparatus as claimed in claim 16, wherein the second logic value is logic "0".

18. The apparatus as claimed in claim 15, wherein the second logic value is logic "0".

* * * * *